US006273266B1

(12) United States Patent
Schabel

(10) Patent No.: US 6,273,266 B1
(45) Date of Patent: Aug. 14, 2001

(54) PROCESS FOR THE WET SCREENING OF STOCK SUSPENSIONS IN PRESSURE GRADERS AND PRESSURE GRADERS SCREEN

(75) Inventor: Samuel Schabel, Ravensburg (DE)

(73) Assignee: Voith Sulzer Papiertechnik Patent GmbH, Ravensburg (DE)

( * ) Notice: Subject to any disclaimer, the term of this patent is extended or adjusted under 35 U.S.C. 154(b) by 0 days.

(21) Appl. No.: 09/534,329

(22) Filed: Mar. 24, 2000

(30) Foreign Application Priority Data

Mar. 25, 1999 (DE) ..... 199 13 515
Apr. 9, 1999 (DE) ..... 199 16 038

(51) Int. Cl.[7] ..... B07B 1/04

(52) U.S. Cl. ..... 209/273; 209/17; 209/155; 209/268; 209/393

(58) Field of Search ..... 209/17, 155, 160, 209/268, 273, 233, 282, 393; 210/360.2, 391, 393, 394

(56) References Cited

U.S. PATENT DOCUMENTS 4,898,665 2/1990 Lamort .
5,768,783 6/1998 Lange .

FOREIGN PATENT DOCUMENTS 2061290 8/1992 (CA) .
3327422 2/1985 (DE) .
0286535 10/1988 (EP) .
0499154 8/1992 (EP) .
0705649 4/1996 (EP) .

*Primary Examiner*—Donald P. Walsh
*Assistant Examiner*—Mark J. Beauchaine
(74) *Attorney, Agent, or Firm*—Greenblum & Bernstein, P.L.C.

(57) ABSTRACT

Process and pressure grader screen for wet screening stock suspensions. The process includes conducting the stock suspension along the screen, so that break-away eddies are formed on an inflow side of the screen, separating portions of the stock suspensions, so that a part of the stock suspension passes through the screen apertures as underflow and an other part is rejected as overflow, and moving the at least one clearer relative to the screen, so that one of pressure- and suction impulses are produced at the screen apertures to form pre- and back flows. In this way, a flow direction of the break-away eddy is reversed by the back flow to rinse a part of the screen lying between the screen aperture with the back flow and an adjacent downstream aperture. The pressure grader screen includes a plurality of bars arranged to form a plurality of essentially parallel grading slots through which an accepted part of the stock suspension passes during the wet screening. The bars have faces located between the grading slots, and the faces each include a front end and a back end. Each back end includes an extension arranged to cover an adjacent grading slot and at least a part of the front end of the face adjacent the adjacent grading slot. Each extension has an underside, such that the underside and the front end are oriented obliquely to each other.

33 Claims, 4 Drawing Sheets

PROCESS FOR THE WET SCREENING OF STOCK SUSPENSIONS IN PRESSURE GRADERS AND PRESSURE GRADERS SCREEN

CROSS-REFERENCE TO RELATED APPLICATIONS

The present application claims priority under 35 U.S.C. § 119 of German Patent Application No. 199 13 515.0, filed on Mar. 25, 1999, and German Patent Application No. 199 16 038.4, filed on Apr. 9, 1999, the disclosures of which are expressly incorporated by reference herein in their entireties.

BACKGROUND OF THE INVENTION

1. Field of the Invention

The invention relates to a process for wet screening of stock suspensions in a pressure grader, and to a pressure grader screen for wet screening of stock suspensions.

2. Discussion of Background Information

An important use of the above-noted process and device is the grading of stock suspensions. In the known process, the fibers contained in the suspension are to pass through the screen, while the undesired solid components are rejected at the slit and conducted out of the screen again. Because the apertures have an essentially elongated shape, e.g., slots or slits, fibrous particles pass through more readily than flat particles, even if both types are present in a similar order of magnitude. With such grading technology, it is therefore possible to achieve a very good separation effect of non-fibrous disruptive substances from stock suspensions. However, it is a prerequisite that the shape of the slot be extremely precise over the entire screen surface. Another important use is the separation of different fibers, in particular fractionation, e.g., based on fiber length or flexibility.

Screens or revolving screens are known, e.g., from published Patent Application DE 33 27 422 A1, in which the grading slots are formed by essentially parallel identical profiles connected to transverse holding ribs. The profiles are shaped and arranged so that, when the screen is in operation, the approach surfaces of the profiles have an oblique contour and a break-away edge behind. This causes the suspension flow sweeping past to undergo a deflection that leads the suspension flow away from the grading slot so that eddies are formed that assist in keeping the grading slots clear and promoting the passage of the fibers through the screen.

In almost all processes of this type, a clearer is moved past close to the screen to produce pressure and suction impulses on one side of the screen. The brief pressure and suction impulses cause the flow direction to reverse in the grading aperture. In this way, the grading aperture is kept clear in that fiber clumps or particles that cannot pass through are conveyed back again against the normal flow-through direction. Pressure and suction impulses can also be introduced into the suspension directly, e.g., via membranes.

The above-mentioned devices have proven to be effective in many applications. However, it is still not always possible to reliably keep the grading slots clear and, at the same time, to conduct the desired high underflow quantity through the screen slots.

In U.S. Pat. No. 4,898,665, a screen device is described in which step-shaped flow barriers ("obstacles") are installed in the inflow area to each screen aperture, which barriers stem the approaching suspension. They also cover the screen apertures partially or completely and produce turbulence in the flow. The eddies thus produced at the end of the flow barrier are intended to guide the flow directly into the screen apertures. However, the flow barriers can also lead to stagnation points on the screen surface at which disruptive deposits settle.

SUMMARY OF THE INVENTION

The present invention provides a process and a screen device of the type generally discussed above, in which the screen is more effectively kept clear, and in which a good cleaning effect and a high screen throughput occur.

The present invention provides a process in which the inflow side of the screen is formed so that a flow direction of a break-away eddy is reversed by a back flow, which rinses a part of the screen lying between the screen aperture in question and a subsequent downstream aperture.

The process of the instant invention also provides that, as it exits from the screen aperture, the back flow is turned so that its flow direction runs in a direction opposite to a circumferential flow of the break-away eddy, and the back flow completely rinses the part of the screen lying between the screen aperture in question and the subsequent downstream screen aperture.

The pressure grader screen of the instant invention provides faces having a back end with extensions, each of which covers an adjacent grading slot and a part of a front end of an adjacent face of an adjacent grading slot. The extensions can extend over a length of at least approximately 0.5 mm of the front face of the adjacent face of the adjacent grading slot, and an underside of the extension facing and the adjacent face can be oriented an angle to each other of between approximately 3°–45°, and preferably between approximately 5°–25°.

In accordance with the features of the present invention, the flow situated in the inflow area of the screen apertures can be advantageously developed. With the aid of the deflection produced, the return flow is not "caught" by the break-away eddy, but flows against its direction directly past the following downstream face of the screen. Here, this area of the screen is formed so that this face is rinsed up to the next following downstream screen aperture. It can also be the case that, during the change in the flow-through direction, microeddies are formed in the inflow area whose rotation direction is opposite to that of the break-away eddy or that the rotation direction of the break-away eddy is even reversed. Due to this feature of the invention, fibers that might adhere to the screen surface are approached by a flow from another side, promoting their detachment from the screen surface. Such residues originate from the pre-flow phase. The same is also true for disruptive substances to be separated, in particular when they tend to stick (e.g., "stickies").

Slot-shaped screen apertures may be particularly suitable for the process, which enable a possible advantage for the process to be achieved particularly effectively. In fact, it has been found that the content of long fibers in the screen underflow (accepted stock) is higher than with conventional screens. Thus, a specific problem of slot grading, namely the loss of long fibers, is more readily solved. However, other shapes that can cause a reverse eddy, e.g., round holes with deflection elements, are also conceivable.

The additional expense required for the shaping of the profile bars can be held within narrow limits. As already mentioned and also known per se, it is possible to produce such devices by fixing profile bars arranged next to one another by fastening elements, e.g., rings. In this way, it can then be sufficient to select a different profile to carry out the invention. While this may necessitate dispensing with standard profiles, this dispensing can be taken into account with the large number of the screens to be produced. The new profiles can generally be used without alteration for screens of extremely different sizes. If drawn profiles, for instance, of steel or a steel alloy, are used as a blank for the bars, it is also possible to produce specific cross-section shapes precisely and economically.

Of course, the profile required for the invention can also be produced by subsequent machining of the surface on the already produced screens.

The flow through the cylindrical screens of the type under consideration here is either centrifugal or centripetal. The meaning of the terms that are familiar per se is as follows: centrifugal relates to radially outwardly directed flows (i.e., inward to outward); and centripetal related to radially inwardly directed flows (i.e., outward to inward). The position of the screen clearers is also not always determined thereby. As is known, there is screen clearing on the accepted stock side and screen clearing on the inflow side. The invention is used advantageously when a clearer is on the inflow side.

The present invention is directed to a process for the wet screening of stock suspensions in a pressure grader that includes a screen with screen apertures and at least one clearer which is movable relative to the screen. The process includes conducting the stock suspension along the screen, so that break-away eddies are formed on an inflow side of the screen, separating portions of the stock suspensions, so that a part of the stock suspension passes through the screen apertures as underflow and an other part is rejected as overflow, and moving the at least one clearer relative to the screen, so that one of pressure- and suction impulses are produced at the screen apertures to form pre- and back flows. In this way, a flow direction of the break-away eddy is reversed by the back flow to rinse a part of the screen lying between the screen aperture with the back flow and an adjacent downstream aperture.

According to a feature of the invention, the screen apertures can be formed as grading slots having longitudinal extensions that extend essentially cross-wise to a movement direction of the at least one clearer, and an axis of the break-away eddies can be approximately parallel to the grading slots.

In accordance with another feature of the present invention, the rinsing of the screen can occur on a side of the screen facing the at least one clearer.

The present invention is directed to a process for the wet screening of stock suspensions in a pressure grader that includes a screen with screen apertures and at least one clearer that is movable relative to the screen. The process includes conducting the stock suspension along the screen provided with screen apertures, such that break-away eddies are formed on an inflow side of the screen, separating portions of the stock suspension so that a part of the stock suspension passes through the screen apertures as underflow and an other part is rejected as overflow, and moving the at least one clearers relative to the screen, so that one of pressure- or suction impulses are produced at the screen apertures to form pre- and back flows. In this way, as it exits the screen aperture, the back flow is turned so that its flow direction runs in a direction opposite a circumferential flow of the break-away eddy, such that the back flow completely rinses a part of the screen lying between the screen aperture with the back flow and an adjacent downstream screen aperture.

According to a feature of the invention, the screen apertures can be formed as grading slots having longitudinal extension that extend essentially cross-wise to a movement direction of the at least one clearer, and an axis of the break-away eddies is approximately parallel to the grading slots.

According to another feature of the present invention, the rinsing of the screen can occur on a side of the screen facing the at least one clearer.

The present invention is directed to a pressure grader screen for the wet screening of stock suspensions that includes a plurality of bars arranged to form a plurality of essentially parallel grading slots through which an accepted part of the stock suspension passes during the wet screening. The bars have faces located between the grading slots, and the faces each include a front end and a back end. Each back end includes an extension arranged to cover an adjacent grading slot and at least a part of the front end of the face adjacent the adjacent grading slot. Each extension has an underside, such that the underside and the front end are oriented obliquely to each other.

In accordance with a feature of the instant invention, the at least a part of the front end covered by the extension can be a length of at least approximately 0.5 mm, and the underside and the front end can be oriented at an angle of between approximately 3° and 45°. Further, the underside and the front end can be oriented at an angle of between approximately 5° to 25°.

According to still another feature of the invention, the at least a part of the front end covered by the extension can be a length of at least approximately 1 mm.

The extensions can lie on inflow sides of the faces at which the stock suspension flows into the grading slot during operation.

The back end is located on a downstream portion of the face, relative to an approach flow of the stock suspension during operation of the pressure grader.

According to a further aspect of the present invention, the faces can be oriented at an angle to a screen surface of between approximately 5° and 50°. Further, the angle between the faces and the screen surface can be between approximately 10° to 30°.

In accordance with a still further aspect of the invention, the face is free of edges on which stagnation points could occur during operation.

Moreover, the underside can be oriented at an angle of between approximately 2° and 40° to a screen surface. Further, the underside and the screen surface may be oriented at an angle between approximately 5° to 25°.

Still further, the invention includes reinforcing elements having depressions adapted to accept at least some of the plurality of bars. The bars can include predetermined profiles and at least some of the plurality of bars can be fixed in the reinforcing elements. The at least some of the plurality of bars can be fixed in the reinforcing elements by stresses resulting from plastic deformation of the reinforcing elements. Further, several spacer noses can be provided, such that the several spacer noses are coupled to the undersides and distributed over a longitudinal extension of the bars, and the several spacer noses are supported on the faces covered by the undersides. Moreover, the reinforcing elements can include rings, and the screen is adapted as a revolving cylindrical screen, or the reinforcing elements and the at least some of the plurality of bars are arranged in planes parallel to one another, and the screen is a flat screen.

According to another aspect of the invention, a screen width can be between approximately 0.08 and 2 mm.

In accordance with still another aspect of the invention, the extensions may extend essentially along an entire length of the grading slots.

According to a further feature of the invention, the extensions may be repeatedly partitioned in the longitudinal direction of the grading slots.

In accordance with a still further feature of the present invention, a shape of the extensions along the grading slots can be non-uniform.

In accordance with another feature of the instant invention, a length of the grading slots may not be greater than approximately 10 mm.

The present invention is directed to a process for the wet screening of stock suspensions in a pressure grader that includes a screen with screen apertures and at least one clearer which is movable relative to the screen. The process includes creating break-away eddies on an inflow side of the screen, separating portions of the stock suspensions, so that a part of the stock suspension passes through the screen apertures as underflow and an other part is rejected as overflow, producing one of pressure- and suction impulses at the screen apertures, thereby forming pre- and back flows, and rinsing a part of the screen lying between the screen aperture with the back flow and an adjacent downstream aperture.

According to an aspect of the invention, the rinsing can include reversing a flow direction of the break-away eddy with the back flow.

In accordance with yet another feature of the present invention, the rinsing can include turning the back flow so that its flow direction runs in a direction opposite a circumferential flow of the break-away eddy.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
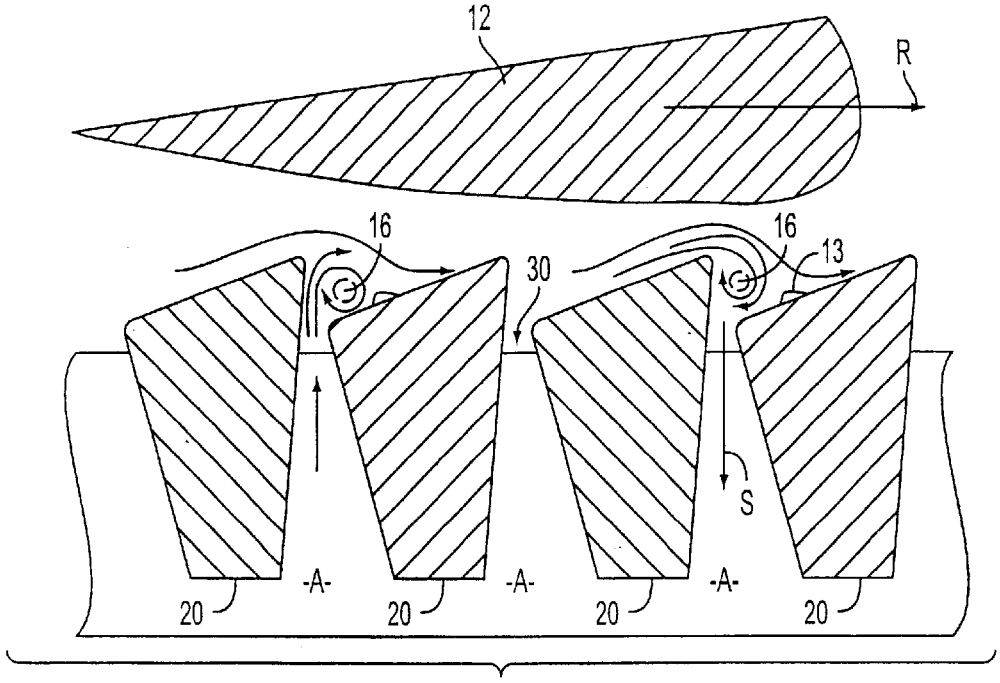
FIG. 1 (PRIOR ART)
FIG. 1 illustrates flow conditions at an inflow of a pressure grader screen according to the prior art.

FIG. 1 schematically illustrates the prior art, and, in particular, a screen having grading slots 30 that are formed between bars 20 arranged in parallel. Flow lines in two different flow situations are represented by free-hand arrows. The suspension flows through grading slot 30 (shown on the right) from an inflow side of the screen aperture to an outflow side in slot flow-through direction S. In flow direction S, the screen is utilized for it actual purpose, i.e., enabling a part of the suspension fine enough to pass grading slot 30 into underflow A, while another part of the suspension is retained as overflow. Dextrorotatory break-away eddies 16 can be formed due to the approach flow direction and the profile shape of grading bars 20. In view of this flow, a stagnation point 13, which is symbolically depicted as a small deposit, can be formed between eddy 16 and the flowing-away, which cannot be avoided. The suspension flows through screen aperture 30 at first based upon a constantly applied excess pressure. Moreover, as is known in the art, suction impulses can be produced by movement of a clearer 12. The conditions at grading slot 30 during the suction impulse are depicted on the lefthand side of FIG. 1, in which the flow in grading slot 30 is briefly directed upwardly, i.e., against the actual production flow. Dextrorotatory break-away eddy 16 is maintained by the suction impulse.

Figure 2:
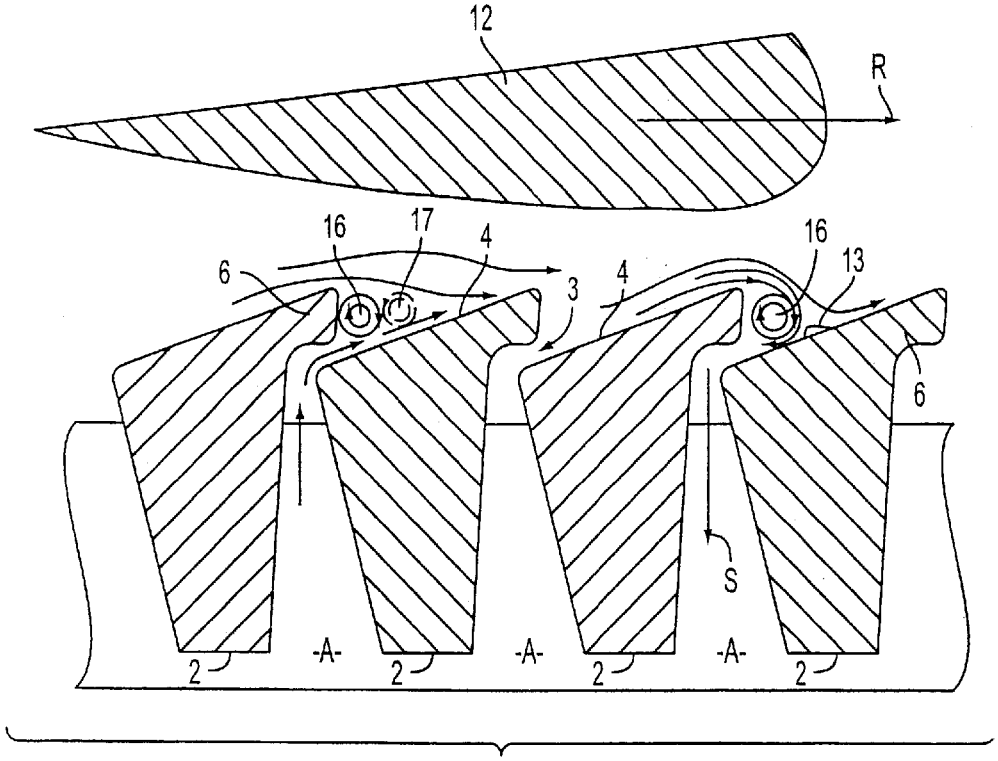
FIG. 2 illustrates flow conditions in accordance with the features of the instant invention.

The conditions are different in the exemplary embodiment of FIG. 2, where bars 2 are structured and arranged so that rinsing of the screen occurs on a side of the screen facing clearer 12. As illustrated, it is apparent that the structure and arrangement of bars 2 substantially avoids dextrorotatory break-away eddy 16 at grading slot 3, but instead forms a levorotatory eddy 17. Thus, the danger of deposits forming in the inflow area can be considerably reduced, and the clearing effect is decisively improved. Further, the back flow can flow directly and unhindered along face 4 so as to rinse free stagnation point 13 (formed in a pre-flow phase).

In cases in which clearer 12 is on an underflow side of the screen (not shown here), instead of a suction impulse, a pressure impulse leads to the reversal of the flow direction in the screen aperture. In such an embodiment, the instant invention can also be utilized.

Figure 3:
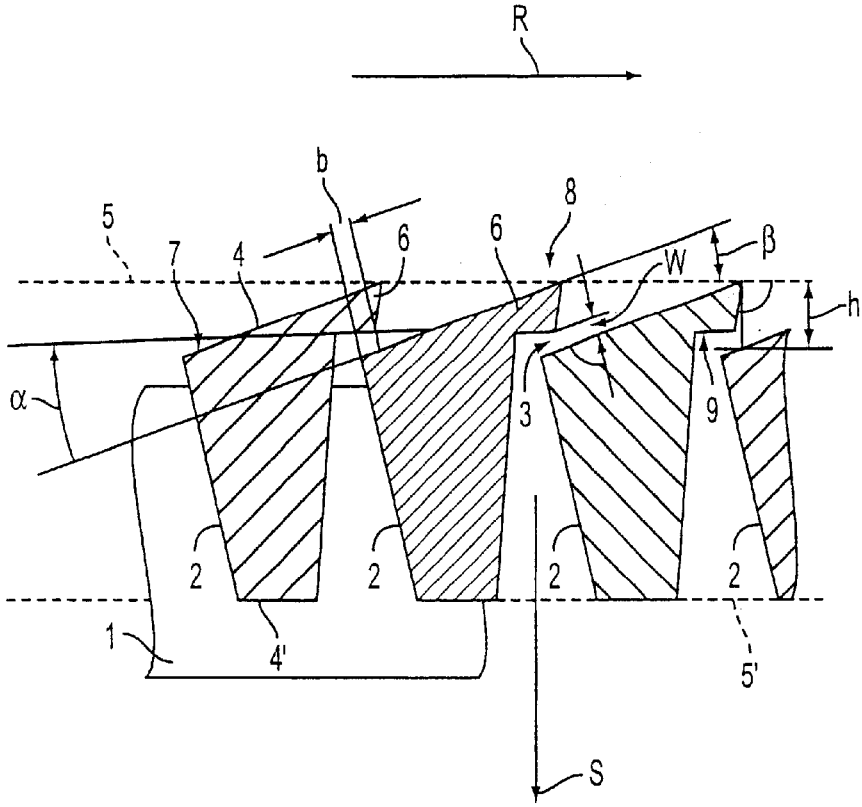
FIG. 3 illustrates a partial sectional view of a pressure grader screen of the present invention.

A sectional view of a portion of a pressure grader screen in accordance with the features of the present invention is illustrated in FIG. 3. The pressure grader screen is a bar screen in which grading slots 3 are formed between bars 2, which are inserted into a reinforcing element 1. A profile of bars 2 is depicted in a somewhat simplified form, such as without the customary curvatures. When the device is in operation, an accepted portion of the suspension flows through grading slot 3 as a screen underflow in slot flow-through direction S, i.e., downwardly in the illustrated example. Screen surfaces 5 or 5' depict imaginary connecting surfaces of bars 2 on the inflow or outflow side of the screen, respectively. Bars 2 have faces 4 on the inflow side and faces 4' on the outflow side. Faces 4 of the inflow side are delimited by or formed with a front end 7 and a back end 8. After the suspension has passed inflow-side face 4 in flow direction R, i.e., at its back end 8, it forms an eddy with an axis lying approximately in the longitudinal direction of grading slot 3, which improves the clearing effect when the pressure grader is in operation.

According to the invention, faces 4 can be provided at their back end 8 with extensions 6, which are shaped so as to cover not only grading slot 3, but also front end 7 of an adjacent bar 2 following grading slot 3. The portion of face 4 of the following bar 2 which is covered, i.e., measured parallel to the face, has a length b, e.g., at least approximately 0.5 mm. Extension 6 has an underside 9 facing front end 7 of adjacent bar 2, and underside 9 and front end 7 can be oriented to form an angle $\alpha$ to one another that is, e.g., between approximately 3° and 45°, and preferably between approximately 8° and 25°. The selection of angle $\alpha$ ensures that a flow cross-section, viewed in the pre-flow direction, broadens. In this way, the suspension can be accelerated in the opposite direction, i.e., in the direction of the back flow, which is favorable for the dissolving and rinsing off of clumps or stagnation points 13.

In cases in which the screen is not constructed of bars, but, e.g., of slots of a previously closed screen blank, extensions 6 can be formed, e.g., by subsequent plastic deformation such that they likewise cover grading slot 3 and the adjacent area of the screen body.

Slot width w, which is decisive for the screen characteristics, is formed, as is shown for the second and third grading bars 2, between underside 9 of extension 6 and face 4 of the adjacent bar. Faces 4 are inclined in approach flow direction R so that they rise at an angle of inclination $\beta$ to screen surface 5, which results in the approaching suspension being deflected from slot flow-through direction S. As a result of this inclination, a difference h from face 4 of the adjacent bar, measured perpendicularly to screen surface 5, is formed at back end 8 of an upstream bar. The volume formed by difference h promotes the desired eddy.

In general, extensions 6 can run uniformly along an entire length of bars 2, so that same flow conditions prevail overall. However, it is also conceivable to install a number of smaller extensions instead of a continuous extension, e.g., in order to produce advantageous cross-eddies. Another possibility is to make the projecting length of extensions 6 different. Since different solid concentrations, e.g., disruptive material concentrations, occur along bars 2 when the pressure grader is in operation, a change in the shape or size of extensions 6 can offer an additional opportunity for optimization.

Figure 4:
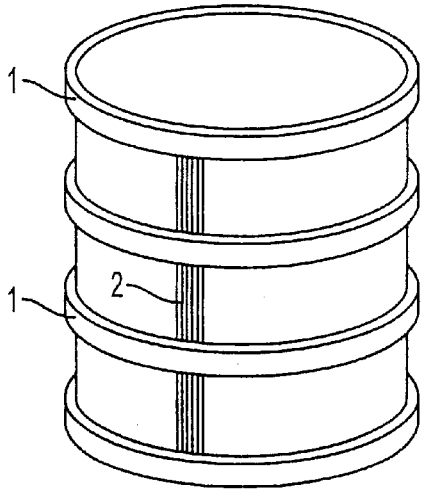
FIG. 4 illustrates a cylindrical revolving screen.

The pressure grader screen of the present invention can be formed in accordance with the exemplary illustration shown in FIG. 4 as a revolving cylindrical screen held together by several ring-shaped reinforcing elements 1. While the figure shows only a portion of the bars 2 present and does not depict the extensions, it is noted that the structure and arrangement of bars 2 is in accordance with the features of the instant invention.

Figure 5:
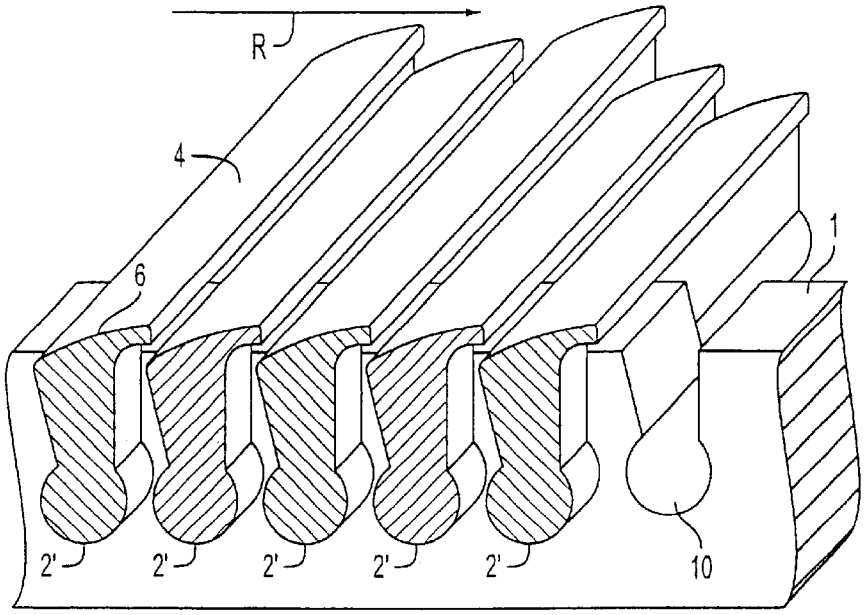
FIG. 5 illustrates a perspective view of a variation of the exemplary embodiment.

In FIG. 5, a perspective view of a part of an another exemplary embodiment of the pressure grader screen of the invention is shown. A reinforcing element 1 is shown, into which bars 2' are to be inserted. The profile of bars 2' on the side inserted into reinforcing elements 1 has thickenings, the specific shape of which is connected with its manufacture. When bars 2' are being inserted, depressions 10 in reinforcing elements 1 are opened far enough to enable the bars to be inserted easily. The depressions are narrowed by plastic deformation of reinforcing elements 1, and bars 2' are then clamped in reinforcing elements 1. The finished screen is then equipped with perfectly fixed bars.

Figure 6:
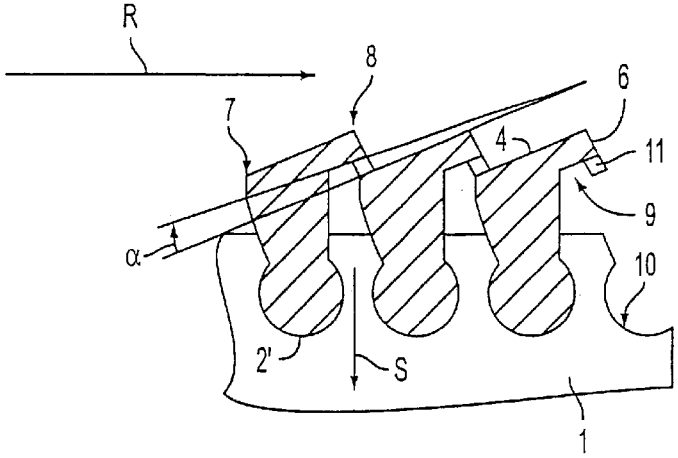
FIG. 6 illustrates a sectional view of another variation of the exemplary embodiment.

According to FIG. 6, underside 9 of extensions 6 of bars 2" is provided with spacer noses 11, which enable the gap width to be maintained with particular precision. As depicted in the longitudinal extension of bars 2", spacer noses 11 can be far apart from one another, e.g., about 200 mm. In cases in which relatively short slots, e.g., approximately 0.5 to 2 mm, are utilized for reasons of screen technology, a correspondingly large number of spacer noses can be utilized.

Figure 7:
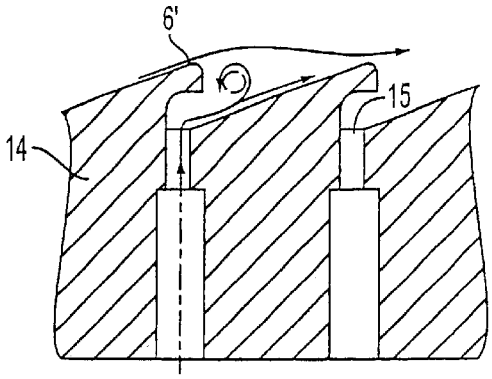
FIG. 7 illustrates a variation of the exemplary embodiment having round screen apertures.

FIG. 7 illustrates an embodiment in which pressure grader screen 14 is provided with round screen apertures 15. A reversal of the direction of eddy rotation is brought about by extensions 6'.

Figure 8:
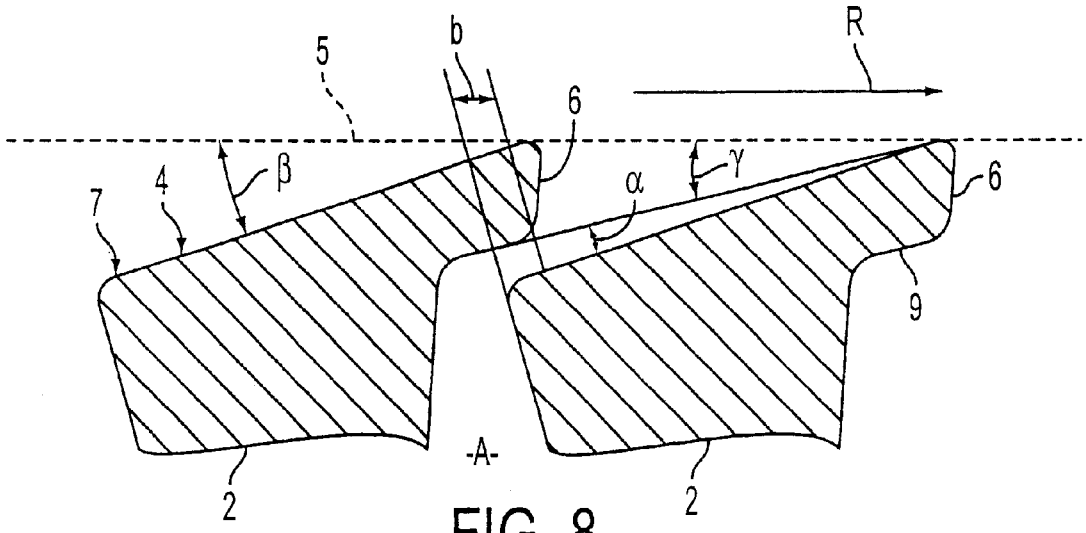
FIG. 8 illustrates a detail of the inflow area.

In FIG. 8, geometric relationships on the inflow side of the screen are shown in somewhat greater detail. Similar to the embodiment depicted in FIG. 6, underside 9 of extensions 6 can be oriented at an angle of inclination $\gamma$ to screen surface 5, i.e., not parallel to it, with the inclination being between approximately 2° and 40°. Face 4 can also be inclined relative to screen surface 5, e.g., at an angle of inclination $\beta$ between approximately 5° and 50°. Thus, a diagonal channel may be formed at a diagonal face 4, which ensures the desired rinsing of faces 4 even under unfavorable conditions.

Figure 9:
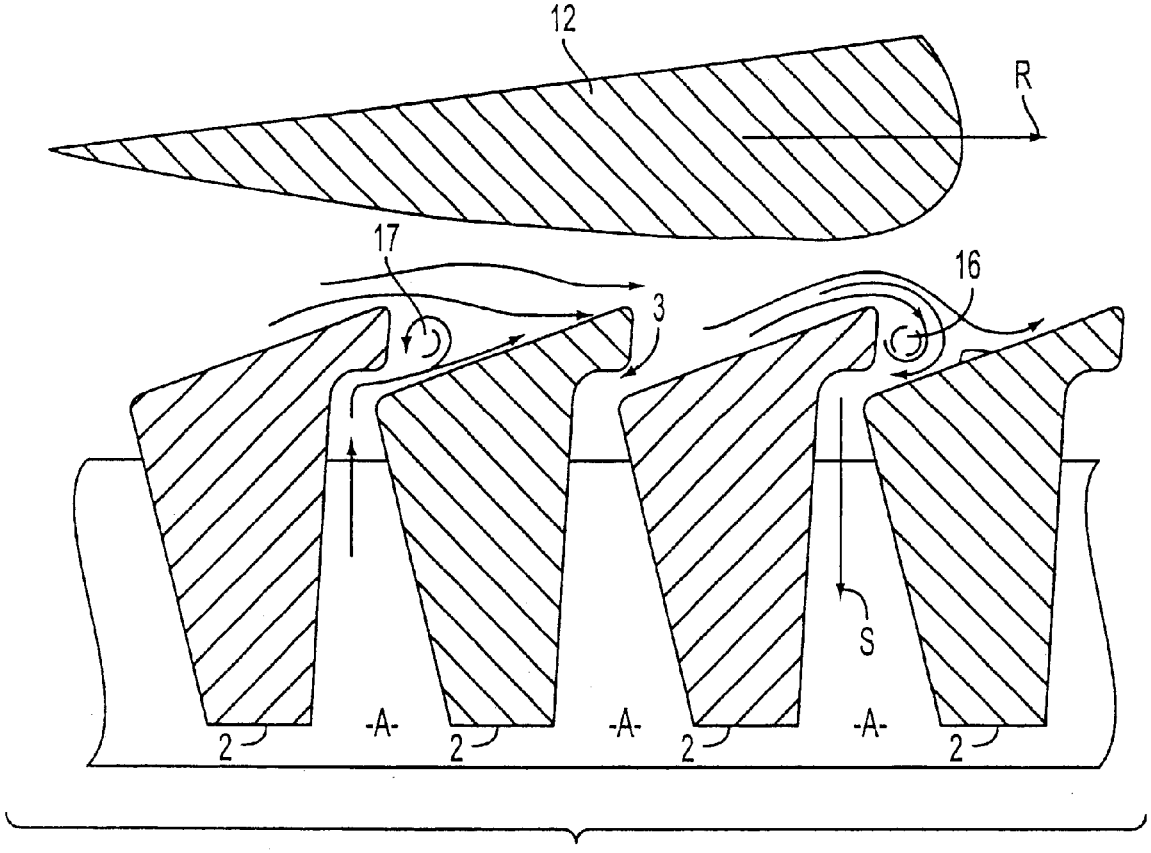
FIG. 9 illustrates a variation of the flow conditions.

FIG. 9 shows a particularly strong effect of the measures of the present invention, in which dextrorotatory break-away eddy 16 is converted into levorotatory eddy 17 under back flow so as to rinse face 4 of bars 2.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for the wet screening of stock suspensions in a pressure grader that includes a screen with screen apertures and at least one clearer which is movable relative to the screen, the process comprising:

conducting the stock suspension along the screen, whereby break-away eddies are formed on an inflow side of the screen;

separating portions of the stock suspensions, wherein a part of the stock suspension passes through the screen apertures as underflow and an other part is rejected as overflow; and moving the at least one clearer relative to the screen, whereby one of pressure- and suction impulses are produced at the screen apertures to form pre- and back flows, wherein a flow direction of the break-away eddy is reversed by the back flow to rinse a part of the screen lying between the screen aperture with the back flow and an adjacent downstream aperture.

2. The process according to claim 1, wherein the screen apertures are formed as grading slots having longitudinal extension that extend essentially cross-wise to a movement direction of the at least one clearer, and an axis of the break-away eddies is approximately parallel to the grading slots.

3. The process according to claim 1, wherein the rinsing of the screen occurs on a side of the screen facing the at least one clearer.

4. A process for the wet screening of stock suspensions in a pressure grader that includes a screen with screen apertures and at least one clearer that is movable relative to the screen, the process comprising:

conducting the stock suspension along the screen provided with screen apertures, whereby break-away eddies are formed on an inflow side of the screen;

separating portions of the stock suspension so that a part of the stock suspension passes through the screen apertures as underflow and an other part is rejected as overflow;

moving the at least one clearers relative to the screen, whereby one of pressure- or suction impulses are produced at the screen apertures to form pre- and back flows, wherein, as it exits the screen aperture, the back flow is turned so that its flow direction runs in a direction opposite a circumferential flow of the break-away eddy, such that the back flow completely rinses a part of the screen lying between the screen aperture with the back flow and an adjacent downstream screen aperture.

5. The process according to claim 4, wherein the screen apertures are formed as grading slots having longitudinal extensions that extend essentially crosswise to a movement direction of the at least one clearer, and an axis of the break-away eddies is approximately parallel to the grading slots.

6. The process according to claim 4, wherein the rinsing of the screen occurs on a side of the screen facing the at least one clearer.

7. A pressure grader screen for the wet screening of stock suspensions, comprising:

a plurality of bars arranged to form a plurality of essentially parallel grading slots through which an accepted part of the stock suspension passes during the wet screening;

said bars having faces located between the grading slots, said faces each including a front end and a back end;

each said back end including an extension arranged to cover an adjacent grading slot and at least a part of the front end of the face adjacent said adjacent grading slot; and each said extension having an underside, wherein said underside and said front end are oriented obliquely to each other.

8. The pressure grader screen according to claim 7, wherein said at least a part of the front end covered by said extension is a length of at least approximately 0.5 mm, and wherein said underside and said front end are oriented at an angle of between approximately 3° and 45°.

9. The pressure grader screen according to claim 8, wherein said underside and said front end are oriented at an angle of between approximately 5° to 25°.

10. The pressure grader screen according to claim 7, wherein said at least a part of the front end covered by said extension is a length of at least approximately 1 mm.

11. The pressure grader screen according to claim 7, wherein said extensions lie on inflow sides of said faces at which the stock suspension flows into the grading slot during operation.

12. The pressure grader screen according to claim 7, wherein said back end is located on a downstream portion of said face, relative to an approach flow of the stock suspension during operation of the pressure grader.

13. The pressure grader screen according to claim 7, wherein said faces are oriented at an angle to a screen surface of between approximately 5° and 50°.

14. The pressure grader screen according to claim 13, wherein said angle between said faces and said screen surface is between approximately 10° to 30°.

15. The pressure grader screen according to claim 7, wherein said face is free of edges on which stagnation points could occur during operation.

16. The pressure grader screen according to claim 7, said underside is oriented at an angle of between approximately 2° and 40° to a screen surface.

17. The pressure grader screen according to claim 16, wherein said underside and said screen surface are oriented at an angle between approximately 5° to 25°.

18. The pressure grader screen according to claim 7, further comprising reinforcing elements having depressions adapted to accept at least some of said plurality of bars, wherein said bars comprise predetermined profiles and at least some of said plurality of bars are fixed in said reinforcing elements.

19. The pressure grader screen according to claim 18, wherein said at least some of said plurality of bars are fixed in said reinforcing elements by stresses resulting from plastic deformation of said reinforcing elements.

20. The pressure grader screen according to claim 18, further comprising several spacer noses, wherein said several spacer noses are coupled to said undersides and distributed over a longitudinal extension of said some of said plurality of bars, and wherein said several spacer noses are supported on said faces covered by said undersides.

21. The pressure grader screen according to claim 18, wherein said reinforcing elements comprise rings, and said screen is adapted as a revolving cylindrical screen.

22. The pressure grader screen according to claim 18, said reinforcing elements and said at least some of said plurality of bars are arranged in planes parallel to one another, and said screen is a flat screen.

23. The pressure grader screen according to claim 7, wherein a screen width is between approximately 0.08 and 2 mm.

24. The pressure grader screen according to claim 7, wherein said extensions extend essentially along an entire length of said grading slots.

25. The pressure grader screen according to claim 7, wherein said extensions are repeatedly partitioned in the longitudinal direction of said grading slots.

26. The pressure grader screen according to claim 7, wherein a shape of said extensions along said grading slots is non-uniform.

27. The pressure grader screen according to claim 7, wherein a length of said grading slots is not greater than approximately 10 mm.

28. A process for the wet screening of stock suspensions in a pressure grader that includes a screen with screen apertures and at least one clearer which is movable relative to the screen, the process comprising:

creating break-away eddies on an inflow side of the screen;

separating portions of the stock suspensions, wherein a part of the stock suspension passes through the screen apertures as underflow and an other part is rejected as overflow;

producing one of pressure- and suction impulses at the screen apertures, thereby forming pre- and back flows; and rinsing a face part of the screen between the screen aperture with the back flow and an adjacent downstream aperture.

29. The process according to claim 28, wherein the rinsing comprises reversing a flow direction of the break-away eddy with the back flow.

30. The process according to claim 28, wherein the rinsing comprises turning the back flow so that its flow direction runs in a direction opposite a circumferential flow of the break-away eddy.

31. A pressure grader screen for the wet screening of stock suspensions, comprising:

a plurality of bars arranged to form a plurality of essentially parallel grading slots through which an accepted part of the stock suspension passes during the wet screening;

said bars having faces located between the grading slots, said faces each including a front end and a back end;

each said back end including an extension arranged to cover an adjacent grading slot and at least a part of the front end of the face adjacent said adjacent grading slot; and each said extension having an underside, wherein said underside and said front end are oriented obliquely to each other; and reinforcing elements having depressions adapted to fixably retain said plurality of bars, wherein said extensions are arranged on inflow sides of said faces at which the stock suspension flows into the grading slot during operation, and said back end is located on a downstream portion of said face, relative to an approach flow of the stock suspension during operation of the pressure grader.

32. The pressure grader screen according to claim 31, further comprising spacer noses, wherein said spacer noses are coupled to said underside and distributed over a longitudinal extension of some of said plurality of bars, and wherein said spacer noses are supported on said faces covered by said undersides.

33. The process according to claim 28, wherein an entire surface of the face part of the screen between the screen aperture with the back flow and an adjacent downstream aperture is rinsed.

* * * * *